US008122962B2

(12) United States Patent
Croteau

(10) Patent No.: US 8,122,962 B2
(45) Date of Patent: Feb. 28, 2012

(54) APPARATUS AND METHOD FOR DELIQUIFYING A WELL

(75) Inventor: Albert Croteau, Fort Assiniboine (CA)

(73) Assignee: BJC Consulting Ltd., Fort Assiniboine, Alberta (CA)

( * ) Notice: Subject to any disclaimer, the term of this patent is extended or adjusted under 35 U.S.C. 154(b) by 388 days.

(21) Appl. No.: 12/267,064

(22) Filed: Nov. 7, 2008

(65) Prior Publication Data

US 2009/0145608 A1 Jun. 11, 2009

(51) Int. Cl.
*E21B 21/16* (2006.01)
*E21B 21/00* (2006.01)

(52) U.S. Cl. ..... 166/311; 166/105; 166/372

(58) Field of Classification Search ..... 166/311, 166/369, 372, 105, 67, 312; 417/182, 183, 417/184

See application file for complete search history.

(56) References Cited

U.S. PATENT DOCUMENTS

| | | | | |
|---|---|---|---|---|
| 1,609,887 | A | 12/1926 | Russell | |
| 2,061,865 | A | 11/1936 | Wells | |
| 2,080,622 | A * | 5/1937 | McMahon | 166/105.5 |
| 2,654,434 | A * | 10/1953 | Culleton | 166/52 |
| 3,887,008 | A | 6/1975 | Canfield | |
| 4,390,061 | A | 6/1983 | Short | |
| 4,664,603 | A * | 5/1987 | Priestly | 417/172 |
| 4,681,372 | A * | 7/1987 | McClure | 299/8 |
| 5,318,128 | A * | 6/1994 | Johnson et al. | 166/312 |
| 5,360,062 | A * | 11/1994 | White | 166/105 |
| 6,382,321 | B1 * | 5/2002 | Bates et al. | 166/372 |
| 7,073,597 | B2 | 7/2006 | Williams | |
| 2001/0000364 | A1 * | 4/2001 | Entrekin et al. | 8/151.2 |
| 2005/0274527 | A1 | 12/2005 | Misselbrook et al. | |

FOREIGN PATENT DOCUMENTS

| | | |
|---|---|---|
| CA | 2537855 | 3/2005 |
| CA | 2562085 | 10/2005 |

* cited by examiner

*Primary Examiner* — Brad Harcourt
(74) *Attorney, Agent, or Firm* — Bennett Jones LLP

(57) ABSTRACT

The invention is directed to an apparatus, system and method for deliquifying a well. A body having gas supply passages is lowered into a well bore on the end of a string of supply tubing. A string of return tubing is lowered through the supply tubing and is inserted into a return passage in the body. A jet nozzle receives gas from the gas supply passages and elevates a fluid:gas mixture to the surface through the return tubing.

17 Claims, 9 Drawing Sheets

APPARATUS AND METHOD FOR DELIQUIFYING A WELL

FIELD OF THE INVENTION

The present invention relates to an apparatus, system and method for removing fluid from a well bore.

BACKGROUND OF THE INVENTION

In the oil and gas industry, liquid build-up in producing wells is a problem that increasingly impacts the industry in terms of reduced gas rates and ultimate recovery. For example, when natural gas flows to the surface in a producing gas well, the gas carries liquids to the surface if the velocity of the gas is high enough. A high gas velocity results in a mist flow pattern in which fluids are finely dispersed in the gas. As the gas velocity in the production tubing drops with time, the velocity of the liquids carried by the gas declines even faster. Flow patterns of fluids on the walls of the conduit cause fluid to accumulate in the bottom of the well, which can either slow or stop gas production altogether.

With high bottomhole pressure, the gas has considerable velocity and consequently sufficient ability to move fluid up a wellbore without assistance. As pressures decrease, this ability lessens and the well requires deliquification or dewatering techniques or systems which apply energy to remove the interfering fluid to enhance gas production.

Several prior art systems and techniques exist for deliquifying or dewatering including for example, pump-off control, evaporation, wellhead pressure reduction, surfactant injection, stroking pumps, progressing cavity pumps, electrical submersibles, gas-lifts, jet pumps, velocity and siphon strings, ejectors, vortex tools, plunger lifts, and capillary string injecting foamers. However, such systems and techniques include complex, downhole moving parts which require removal for repair or maintenance; lack sufficient durability to withstand downhole conditions; are difficult to transport, install and operate; or are expensive to produce. The trend towards deeper and tighter gas wells requires less bulky, more compact and simpler systems. In lower rate gas wells, cost effective systems or techniques are required because of the limited incremental production capacity. What is needed is an improved apparatus and method for deliquifying a well which mitigates these disadvantages of the prior art.

SUMMARY OF THE INVENTION

The present invention is directed to an apparatus and method for deliquifying a well. In one aspect, the invention comprises an apparatus for removing liquid from a well bore having a well casing, said apparatus comprising;

(a) a body having a gas inlet and a liquid outlet adapted to releasably engage a lower end of a return tube, the body having a lower end defining a liquid inlet;

(b) the body defining at least one gas supply passage extending through the body connecting with the gas inlet, and a return passage extending though the body connecting the liquid inlet and the liquid outlet, wherein the return passage has a venturi chamber; and (d) a jet nozzle directed upwardly and disposed within the venturi chamber, the jet nozzle having an inner bore in fluid communication with the gas supply passage by means of a end member.

In one embodiment, the apparatus comprises two gas inlets adjacent a central liquid outlet, such that the return tube is disposed concentrically within the supply tube. In another embodiment, the gas inlet is adjacent the liquid outlet, such that the return tube and supply tube are adjacent each other.

In one embodiment, the venturi chamber and the jet nozzle have complementary conical shape, and the jet nozzle is surrounded by a venturi gap between the jet nozzle and the venture chamber.

In one embodiment, the apparatus further comprises means for adjusting the position of the jet nozzle within the venturi chamber so as to adjust the size of the venturi gap. The adjusting means may comprises a lower tube attached to the end member, an upper tube slidingly engaging the lower tube, and a lock nut for fixing the relative position of the upper tube to the lower tube, wherein the lower tube and upper tube attach to the jet nozzle.

In one embodiment, the apparatus further comprises at least one one-way valve element within the at least one gas supply passage, said valve element being moveable between an open position permitting gas flow towards the jet nozzle, and a closed position preventing fluid flow towards the supply tube. The valve element may comprise a ball valve having means for biasing the ball valve into closed position, wherein said biasing means may be overcome by gas pressure from the supply tube.

In another embodiment, the apparatus comprises a packer which seals the apparatus to the casing, and wherein the gas inlet is defined by a lateral wall of the body. The body may define at least two lateral gas inlets, connected by an end tube having a central opening for connection to the jet member. In this case, the well casing serves as the supply tubing.

In another aspect, the invention may comprise a method of removing liquid from a well bore to a well head using the apparatus described or claimed herein, the method comprising:

(a) attaching an upper end of the apparatus to the lower end of the supply tubing or the lower end of the return tubing, or both;

(b) lowering the apparatus into the well bore to a depth whereby the inlet is submerged in liquid;

(c) injecting compressed gas into the supply tubing such that the gas is expelled by the jet member creating a suction force in the venturi chamber, thereby drawing liquid up the return passage; and (i) collecting the liquid:gas mixture being discharged by the return tubing at the well head.

In one embodiment, the compressed gas comprises natural gas produced from the well bore.

In one embodiment, the venturi gap is adjusted to select a desired liquid:gas ratio in the discharged mixture.

BRIEF DESCRIPTION OF THE DRAWINGS

The invention will now be described by way of an exemplary embodiment with reference to the accompanying simplified, diagrammatic, not-to-scale drawings.

DETAILED DESCRIPTION OF THE INVENTION

Figure 1:
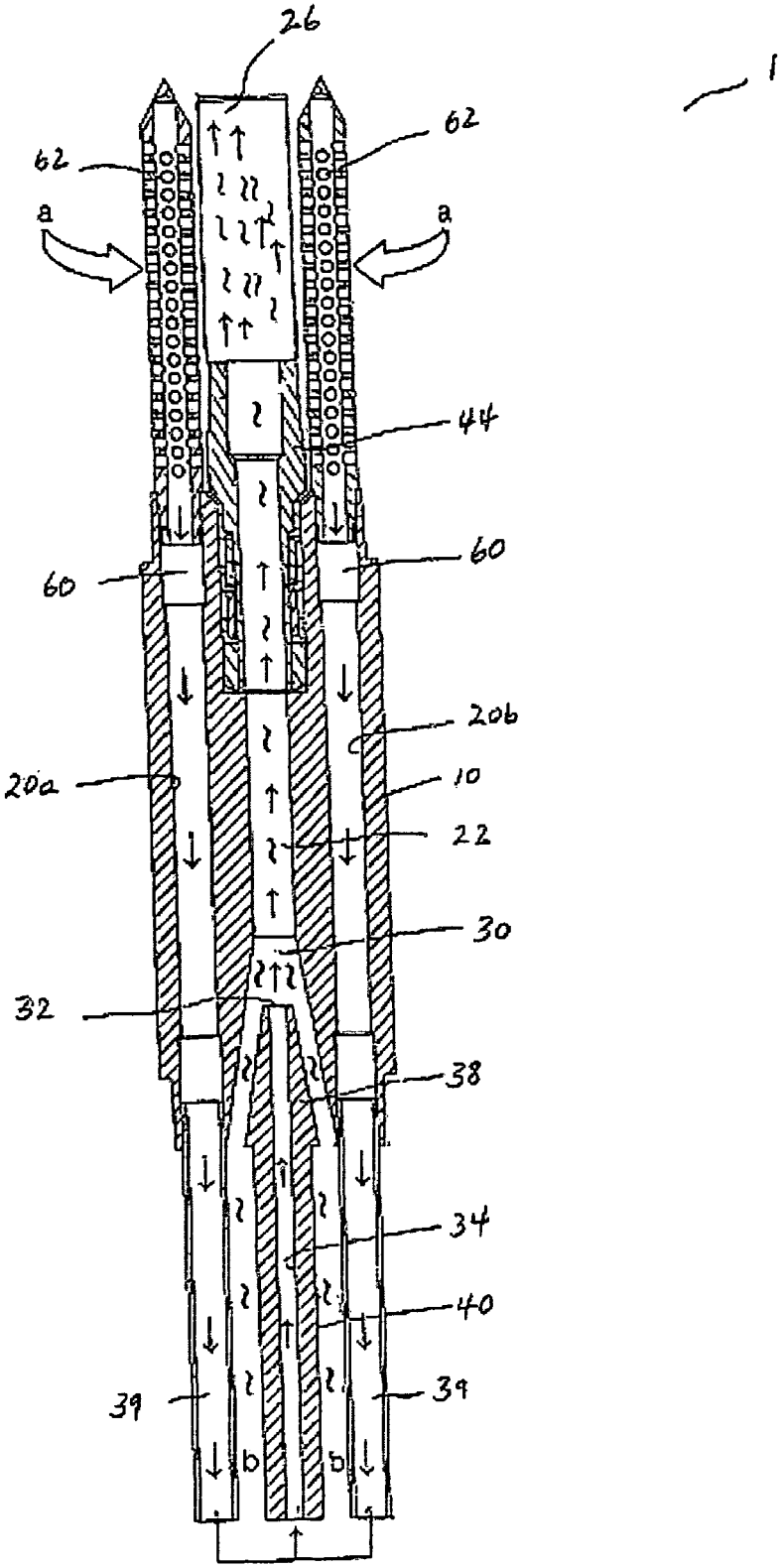
FIG. 1 is a diagrammatic representation of a method of one embodiment of the present invention, indicating the flow of gas, wellbore fluid and fluid:gas mixture through the apparatus.
Figure 2:
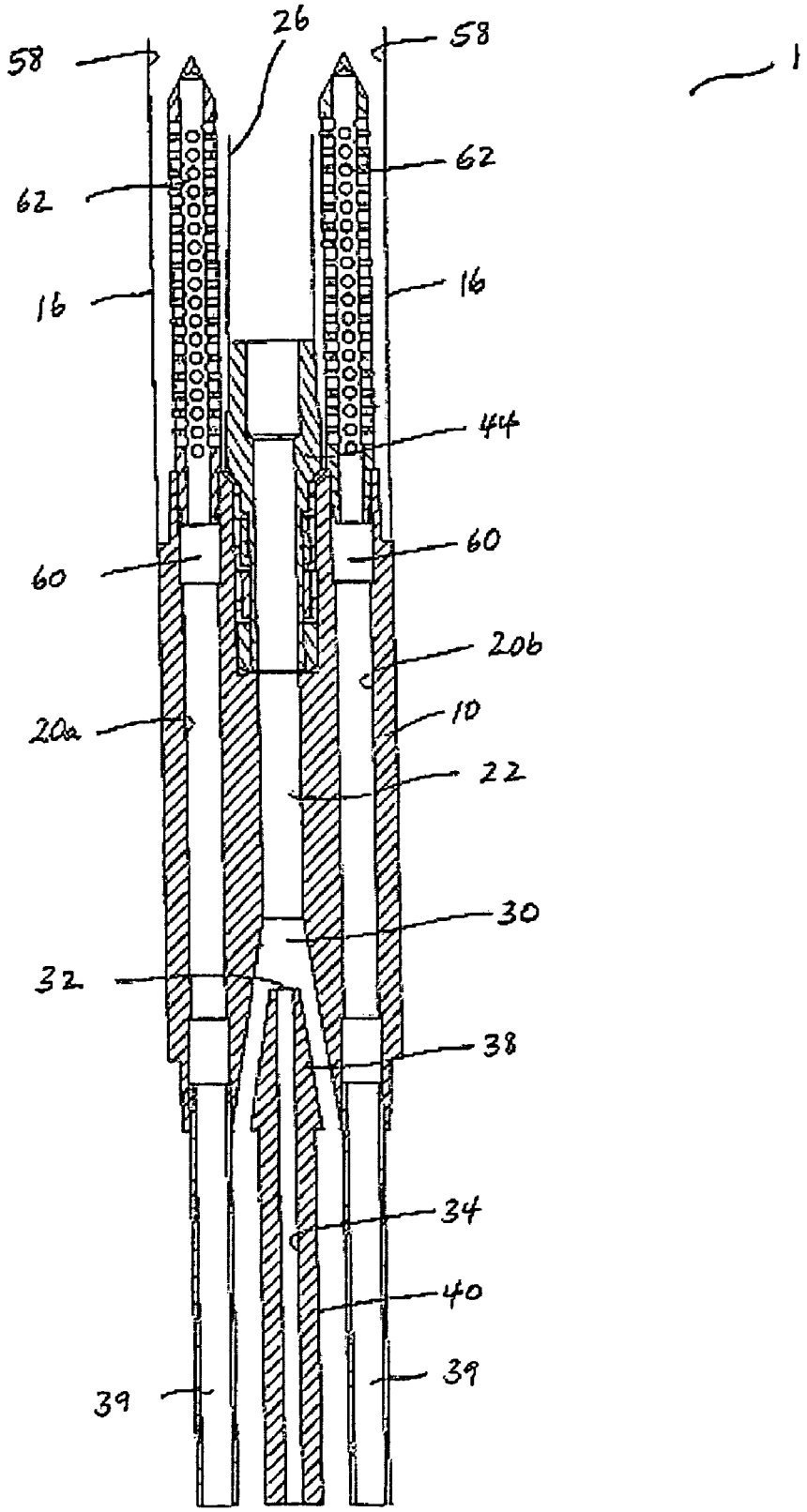
FIG. 2 is a diagrammatic representation of a cross-sectional view of an apparatus of one embodiment of the present invention.
Figure 3A:
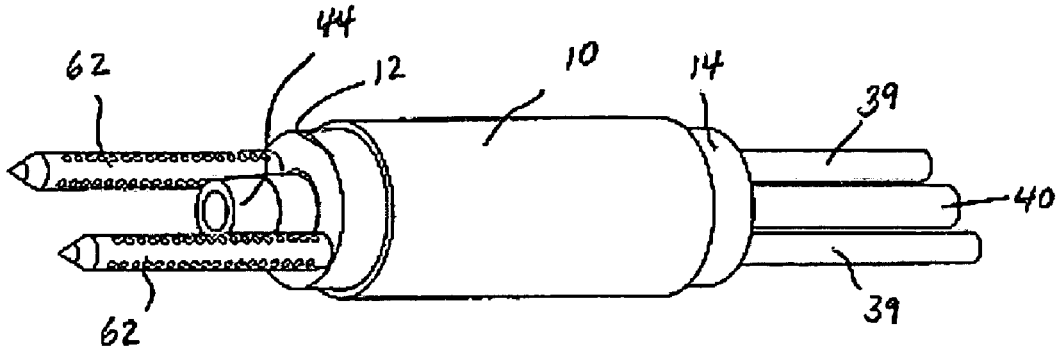
FIG. 3*a* is a diagrammatic representation of an apparatus of one embodiment of the present invention.
Figure 3B:
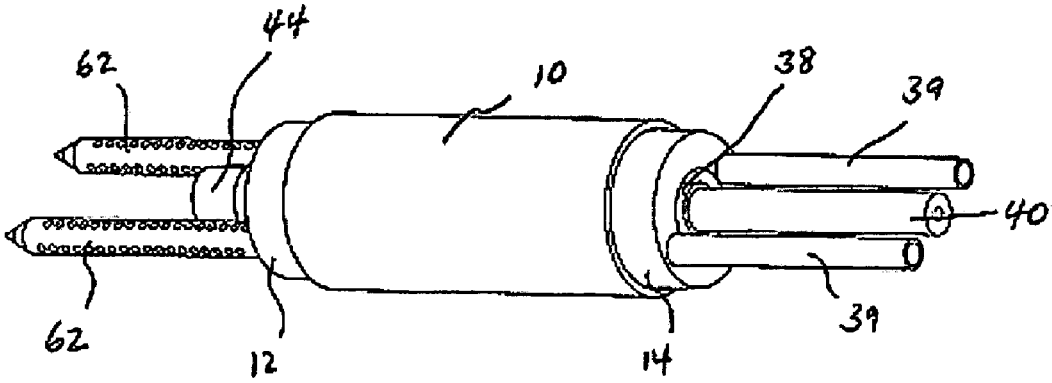
FIG. 3*b* is a diagrammatic representation of an apparatus of one embodiment of the present invention.
Figure 4:
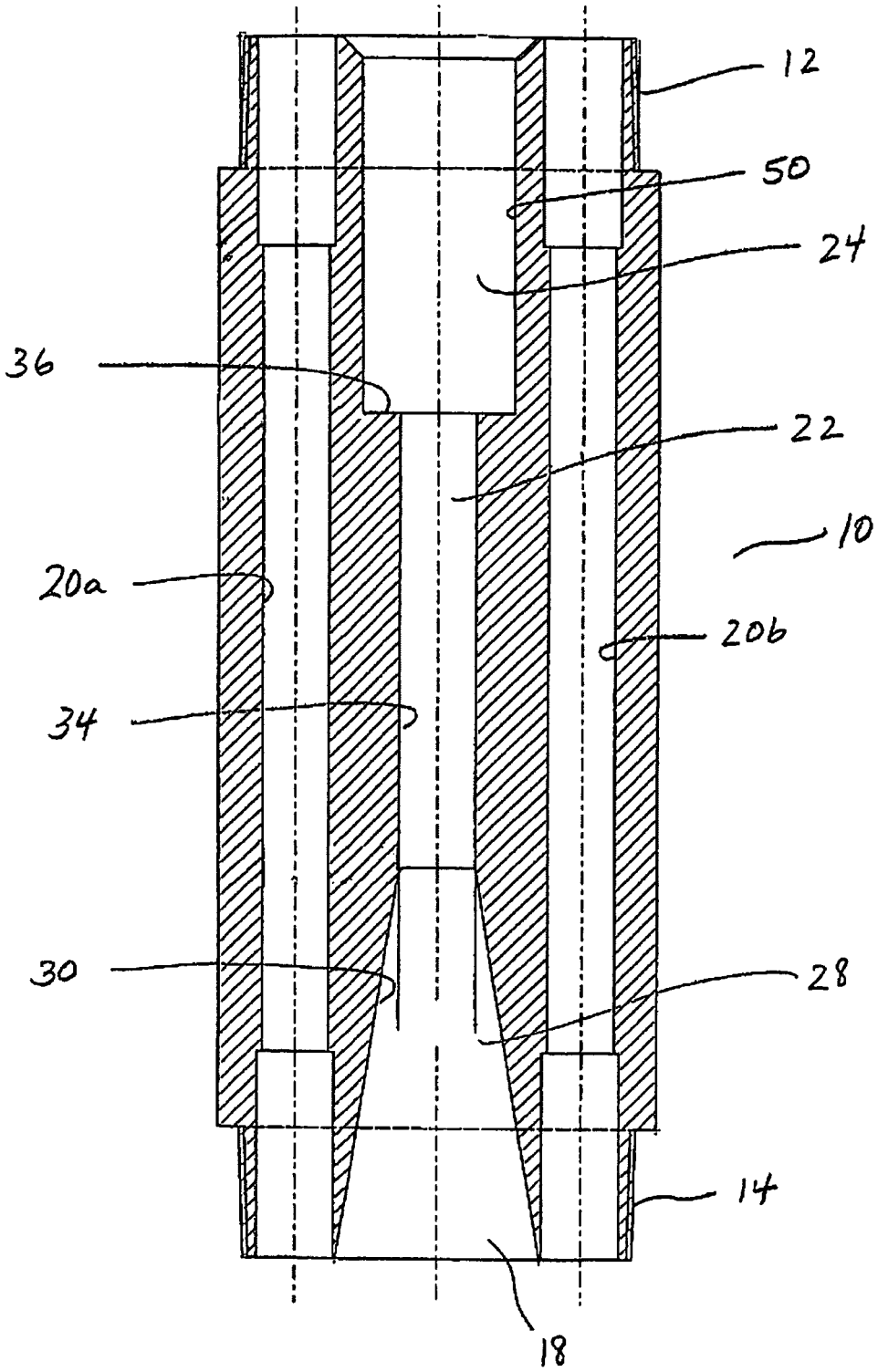
FIG. 4 is a diagrammatic representation of a cross-sectional view of an apparatus of one embodiment of the present invention.

The present invention provides a method and apparatus for deliquifying a well. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

The apparatus removes fluid from a well bore. Compressed gas under pressure conveniently drives the system. It will be understood by those skilled in the art that the apparatus (1) is lowered into the wellbore, for example, within the well casing of a conventional gas well, to contact liquid in the wellbore. As used herein and in the claims, the term "concentric" refers to components sharing a common center and thus a uniform annular dimension. One skilled in the art will recognize that two components may be concentric even if they do not share an exact common centre, and may not be circular in cross-section.

A conventional gas well typically comprises a wellbore extending from the surface through the earth to intersect a production formation, and primarily produces natural gas, condensate (i.e., natural gas liquids such as propane and butane) and occasionally water. The apparatus (1) may be placed in a vertical, horizontal or an inclined wellbore. "Horizontal" means a plane that is substantially parallel to the plane of the horizon. "Vertical" means a plane that is perpendicular to the horizontal plane. Such variations of well design are known to those skilled in the art.

As shown in FIGS. 1 to 4, the apparatus (1) includes a body (10) having an upper end and a lower end (14). A portion of the upper end (12) of the body (10) is adapted to releasably engage an end of a supply tube (16). The lower end (14) of the body (10) has a liquid inlet (18). The body (10) defines at least two gas supply passages (20*a*, 20*b*) extending through the body (10) from the upper end (12) of the body (10) to the lower end (14) of the body (10). The gas supply passages (20*a*, 20*b*) receive compressed gas from the supply tube (16).

In one embodiment, the supply tube (16) comprises standard production tubing. In one embodiment, the supply tube (16) has a diameter of about 2 inches or greater. In one embodiment, the supply tube (16) has a diameter of about 3.5 inches. In one embodiment, the supply tube may comprise coiled or jointed tubular members. A coiled tubular member comprises a continuous length of tubing, while a jointed tubular member comprises lengths of tubing joined together by attachment means including, for example, threaded connections, couplings or other suitable attachment means.

The body (10) defines a return passage (22) extending though the body (10) from the lower end (14) of the body (10) to the upper end (12) of the body (10). The end (24) of the return passage (22) which is closest to the upper end (12) of the body (10) is adapted to receive an end of a return tube (26) in a sealed manner. The other end (28) of the return passage (22) which is closest to the lower end (14) of the body (10) is in fluid communication with the fluid inlet (18). The return passage (22) is comprised of a conical venturi chamber (30) which houses a jet nozzle (32), a central section (34) and a landing seat (36) positioned towards the upper end (12) of the body (20). The landing seat (36) engages the end (not shown) of the return tube (26).

The jet nozzle (32) is disposed within the venturi chamber (30) in the return passage (22), preferably in a position proximate to the lower end (14) of the body (10). The jet nozzle (32) receives compressed gas from the gas supply passages (20*a*, 20*b*). The jet nozzle (32) then directs a stream of compressed gas into the return passage (22) in a direction towards the upper end (12) of the body (20). The stream of compressed gas creates a venturi effect in the venturi chamber (30), drawing liquid up the return passage from the liquid inlet (18). The resultant liquid:gas mixture travels through the return passage (22) into the return tube (26).

In one embodiment, the return tube (26) is sized to fit within the supply tube (16). In one embodiment, the return tube (26) has a diameter of about 2 inches. The end of the return tube (26) engages the return passage (22) of the body (10) after the body (10) has been lowered into the well bore on a length of the supply tube (16).

The jet nozzle (32) is positioned within the venturi chamber (30) to provide a reasonably uniform venturi gap around the jet nozzle. In one embodiment, the position of the jet nozzle is adjustable to vary the size of the venturi gap, thereby adjusting the ratio of the liquid:gas mixture. The jet nozzle (32) comprises a conical member (38) having a central bore (34). The conical member (38) is mounted on and slidingly engages a lower tube (40). A lock nut (42) is threaded on the tube (40). Turning of the nut (42) linearly retracts or advances the conical member (38) out of, or further into, the venturi chamber (30). In the retracted position (i.e., the nut (42) moves away from the body (10)), the conical member (38) retracts out of the venturi chamber (30), thereby allowing a greater flow of fluid from the fluid inlet (18). In the advanced position, i.e., the nut (42) moves towards the body (10), the conical member (38) moves into the conical mixing chamber (30), narrowing the venturi gap, thereby decreasing the withdrawal of liquid. In one embodiment, the conical member may be advanced to contact the venturi chamber, thereby closing off the return passage.

Figure 5A:
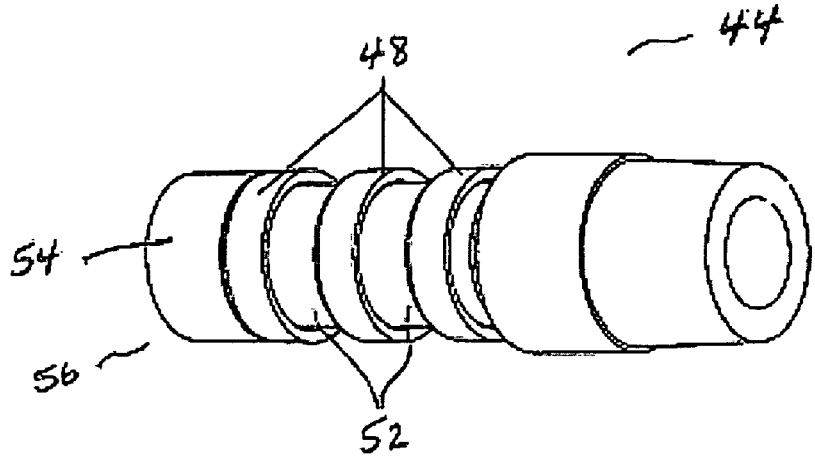
FIG. 5*a* is a diagrammatic representation of a seating nipple of one embodiment of the present invention.
Figure 5B:
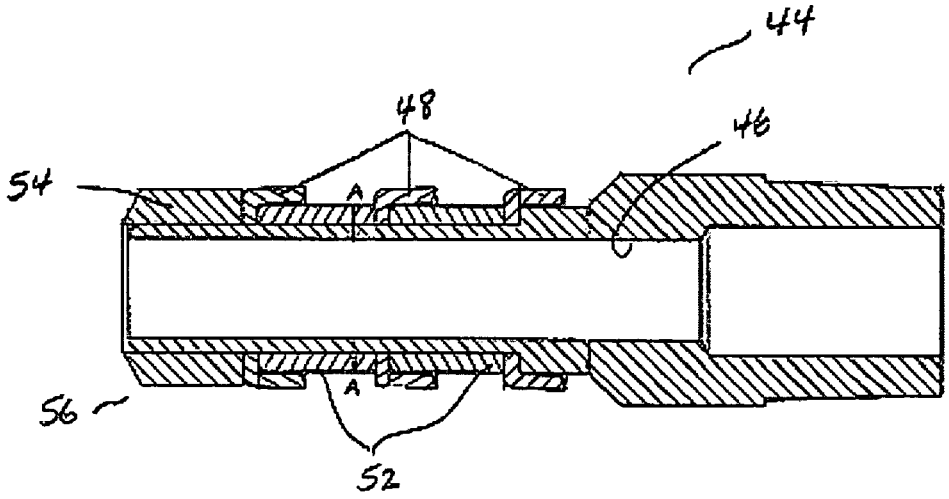
FIG. 5*b* is a diagrammatic representation of a cross-sectional view of the seating nipple of FIG. 5*a*.
Figure 5C:
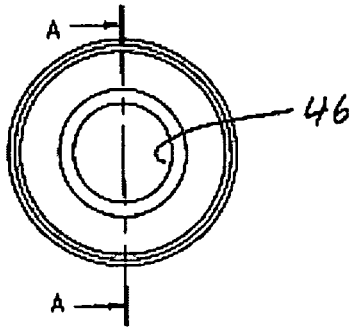
FIG. 5*c* is a diagrammatic representation of a cross-sectional view of the seating nipple of FIG. 5*b* taken along line A-A.
Figure 6:
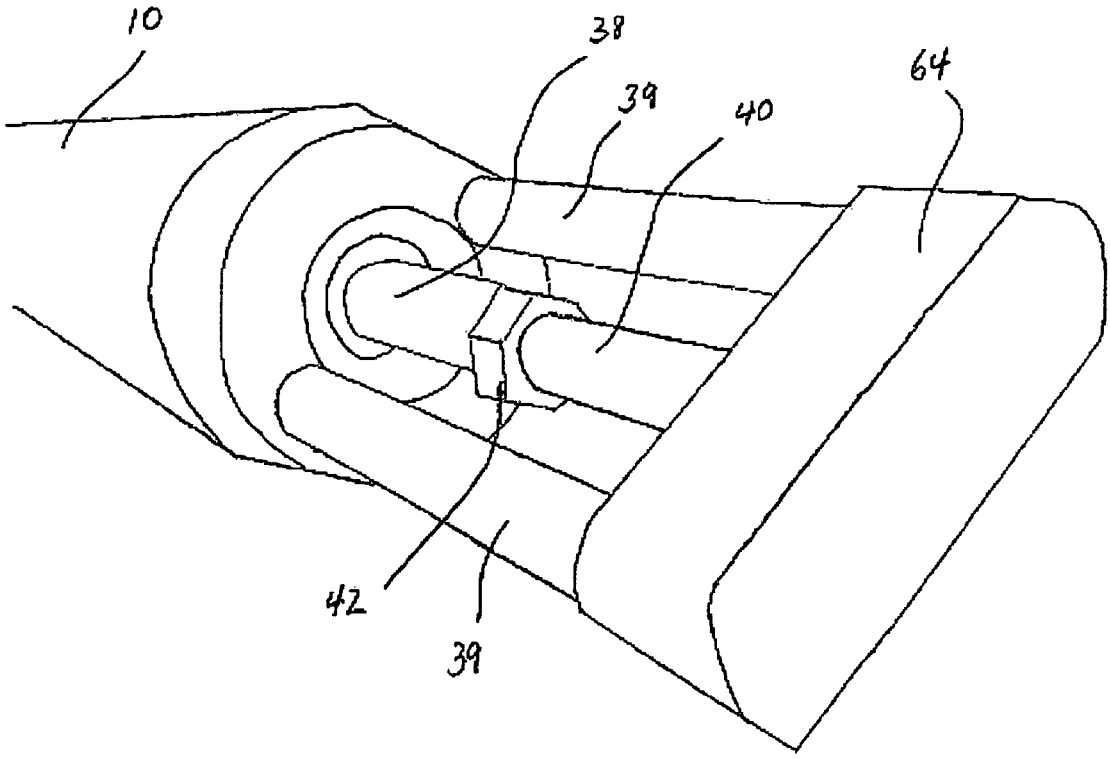
FIG. 6 is a diagrammatic representation of an apparatus of one embodiment of the present invention.

In one embodiment, the apparatus (1) includes a seating nipple (44) having a central bore (46) (FIGS. 5A-C). The seating nipple (44) is releasably attachable to the end of the return tube (26). The seating nipple (44) is inserted into the return passage (22) from the upper end (12) of the body (10). The seating nipple (44) engages the landing seat (36) in a sealed fashion. In one embodiment, the seating nipple (44)

has at least one sealing means (48) on its outer diameter to seal against an inner wall (50) of the return passage (22). In one embodiment, at least one sealing means (48) is a cup seal.

In one embodiment, a plurality of sealing means (48) are separated by one or more spacers (52), which may be formed of, for example, metal. In one embodiment, the sealing means (48) is a cup seal which protrudes over a spacer (52). A nut (54) is threaded at the end (56) of the seating nipple (26) to hold the sealing means (48) and spacers (52) in place.

In one embodiment, the return tube (26) and the seating nipple (44) are landed or dropped into place within the return passage (22), and are held in place by the weight of the return tubing string.

In one embodiment, the apparatus (1) engages a return tube (26) having at least one sealing means on its outer diameter to seal against an inner wall (50) of the return passage (22). The return tube (26) is inserted into the return passage (22) from the upper end (12) of the body (10), and engages the landing seat (36) in a sealed fashion.

In one embodiment, the apparatus may be adapted to accept guidance means releasably mounted on the return tube (26) to guide the end of the return tube (26) or the seating nipple 44) as the case may be, to the return passage (22). The guidance means may comprise pipe-in-pipe centralizing means such as a cylindrical collar member that is mounted on the exterior wall of the return tube (26) and has projections which engage the interior walls (58) of the supply tube (16). In another embodiment, the guidance means comprises a perforated collar; however, any suitable pipe-in-pipe centralizing means as are commonly used in the industry may be employed. The collar member can remain within the well bore without disrupting operation of the apparatus (1). In one embodiment, the collar member is formed of stainless steel.

The apparatus (1) may include at least one valve element (60) within or associated with each of the gas supply passages (20*a*, 20*b*). Each valve element (60) is moveable between open and closed positions in response to conditions of gas pressure or fluid flow within the gas supply passage (20*a*, 20*b*) in which it is located. In one embodiment, the valve element (60) is a check valve which may comprise one-way ball valve element comprising a chamber, aligned inlet and outlet passages providing gas flow there through, a generally spherical ball aligned between the inlet and outlet passages, and resiliently deflectable biasing means moveable between open and closed positions. In the closed position, the biasing means biases the spherical ball against the inlet passage to seal the gas supply passage from fluid flow. In the open position, the biasing means is deflected away from the spherical ball by the pressure of the gas. In one embodiment, the biasing means is a coiled spring.

The apparatus (1) may include perforated projections (62) connected to the end of the gas supply passages (20*a*, 20*b*) closest to the upper end (12) of the body (10). The perforated projections (62) acts as a screen to restrict the entry of debris into the gas supply passages (20*a*, 20*b*).

The gas passages (20*a*, 20*b*) supply gas to the jet nozzle (32) in a sealed manner such that the gas supply from the supply tube (16) is not emitted into the well bore. In one embodiment, a cap end (64) connects pipes (39) extending from the gas supply passages (20*a*, 20*b*) and the jet nozzle threaded shaft (40) to isolate the gas from the wellbore fluid and direct it into the jet nozzle. Since the flow of gas is self-contained, no gas escapes into the formation to affect the surrounding pressure of the well. The cap end (64) is attached by welding or other suitable techniques in the art.

Figure 7:
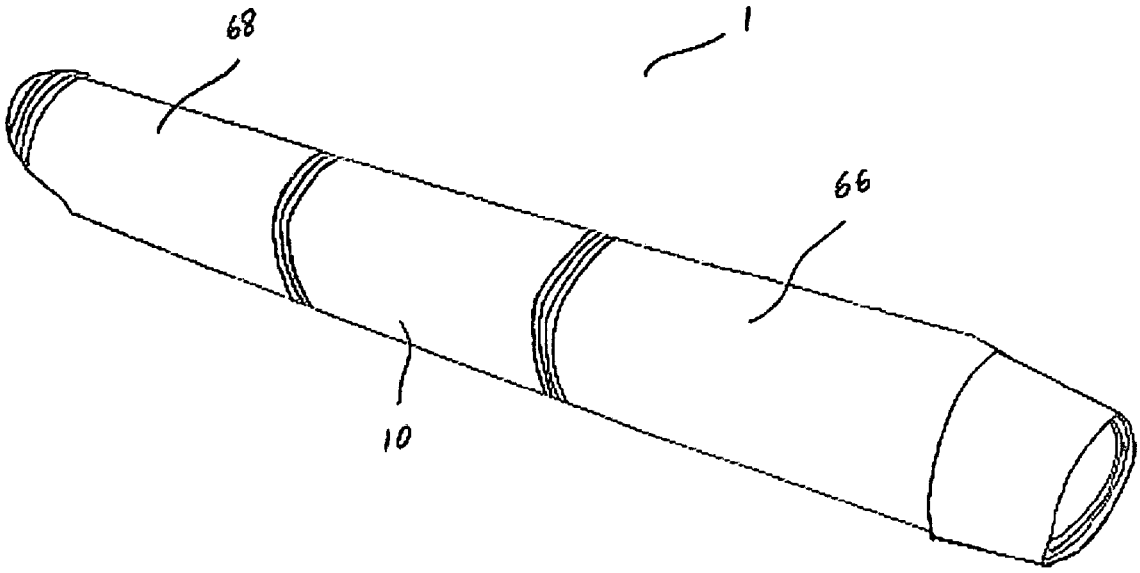
FIG. 7 is a diagrammatic representation of an apparatus of one embodiment of the present invention.

In one embodiment, the fluid inlet (18) at the lower end (14) of the body (10) comprises a screen (66) releasably attachable to the lower end (14) of the body (10) (as shown in FIG. 7). The apparatus (1) is thus able to handle for example, clay fines, sand, coal fines and particles. The screening means is selected from any suitable screen including, for example, a slotted screen, a perforated screen, a sieve screen, a wedge wire screen, or a wire mesh screen.

In one embodiment, the apparatus (1) further comprises a tubular section (68) which is releasably attachable to the upper end (12) of the body (10) (as shown in FIG. 7). The tubular section (68) is configured to thread onto the end of a supply tube (16).

The apparatus (1) and components thereof can be formed of any suitable material, although for strength and durability and to withstand adverse wellbore conditions, the apparatus (1) and components thereof may be formed of steel, stainless steel or other suitable materials displaying resistance to corrosion, abrasion, and extreme temperatures. The sealing means may be formed of, for example, synthetic rubbers, thermoplastic materials, perfluoroelastomer materials or other suitable substances known to those skilled in the art.

During installation, the jet nozzle (32) is adjusted to a select a predetermined fluid:gas ratio by adjust nut (42). In one embodiment, the selected fluid:gas ratio is determined by the well bore conditions, downhole gas pressure and the volume of fluid to be removed. The upper end (12) of the body (10) is attached to the lower end of the supply tube (16) directly or by means of tubular section (68). The body (10) is lowered into the well bore on the supply tubing to a depth whereby at least the lower end (14) of the body (10), or the lower end of the screen (66) is submerged in fluid. The length of the supply tube (16) is secured at the well head.

The return tube (26) is then inserted into the supply tube (16), optionally with the guidance means mounted thereon. The return tube (26) is then lowered until the lower end of the return tube (26) is inserted into the return passage (22) of the body (10). The length of the return tube (26) is secured at the well head. If a seating nipple (44) is being used, it is attached to the return tube (26) before being lowered through the supply tube (16).

FIG. 1 shows the flow of gas (as indicated by "a" and arrows) and wellbore fluid (as indicated by "b" and "~") through one embodiment of the system. In operation, the surface compressor (not shown) injects compressed gas into the supply tube (16). The compressed gas (for example, natural gas, air, nitrogen) is provided from a suitable source such as a surface compressor, for example, a centrifugal compressor, a diagonal or mixed-flow compressor, an axial-flow compressor, a reciprocating compressor, a rotary screw compressor, a scroll compressor, or a diaphragm compressor. The operation of a compressor is commonly known to those skilled in the art and will not be discussed in detail. In general, a compressor raises the pressure of gas by decreasing its volume. In one embodiment, the gas comprises natural gas from the well bore. In one embodiment, the operating pressure ranges from approximately 100 to 600 psi.

Injection of compressed gas may be either batch or continuous injection. The gas injection rate relates to the volume of gas injected into the system during injection. It will be understood by those skilled in the art that preferably injection testing is initially conducted to establish the depth, rate, and pressure at which the compressed gas is injected. The injection rate and operating pressure depend upon several factors including, for example, the depth of the well, the sizes of the casing, tubular members, and well bore; the amount of liquid to be removed; the type of gas; and the power output.

The gas enters through the supply tube (16) into the perforated perforations (62) and passes through the gas supply passages (20*a*, 20*b*) and the central bore (34). To avoid obscuring the indication of flow, FIG. 1 does not illustrate the cap end (64). The jet nozzle (32) projects the stream of compressed gas under pressure into the conical mixing chamber (30). The jet nozzle (32) creates a high velocity flow upwards into the conical mixing chamber (30), creating a jet effect and sucking wellbore fluid upwards around the conical member (38) into the conical mixing chamber (30) where it mixes with the gas. The gas has sufficient velocity to carry the fluid to the surface. The fluid:gas mixture being discharged by the return tube (26) at the well head is then collected at the surface. In one embodiment, approximately 0 to 40 $m^3$ of wellbore fluid may be removed depending upon the status of the well bore.

At the surface, a separator (not shown) separates the water from the gas, directing the water and gas to separate outflow lines for further processing, storage or disposal. All or a portion of the gas may be recycled for future re-injection into the well to remove wellbore fluids. The operation of a separator is commonly known to those skilled in the art. Briefly, a separator comprises a cylindrical or spherical vessel used to separate oil, gas and water from the total fluid stream produced by the well. Separators can be either horizontal or vertical. Separators can be classified into two-phase and three-phase separators, with the two-phase type dealing with oil and gas, and the three-phase type handling oil, water and gas. Gravity segregation is the main force that accomplishes the separation, which means the heaviest fluid settles to the bottom and the lightest fluid rises to the top. Additionally, inside the vessel, the degree of separation between gas and liquid will depend on the separator operating pressure, the residence time of the fluid mixture and the type of flow of the fluid. The well flowstreams enter the vessel horizontally and hit a series of perpendicular plates. This causes liquids to drop to the bottom of the vessel while gas rises to the top. Gravity separates the liquids into oil and water. The gas, oil and water phases are metered individually as they exit the unit through separate outflow lines.

At shut-down, the system is cleaned out by reversing the gas flow to purge any remaining wellbore fluid in the return tube. In one embodiment, a short burst of compressed gas is injected into the return tubing at the well head to remove fluid from the return tube and the return passage before injecting compressed gas into the supply tube. Where a valve (60) is provided, the valve (60) will prevent wellbore fluid from backing into the supply tube (16). In one embodiment, an inert gas such as nitrogen is used for cleaning out the system.

Figure 8A:
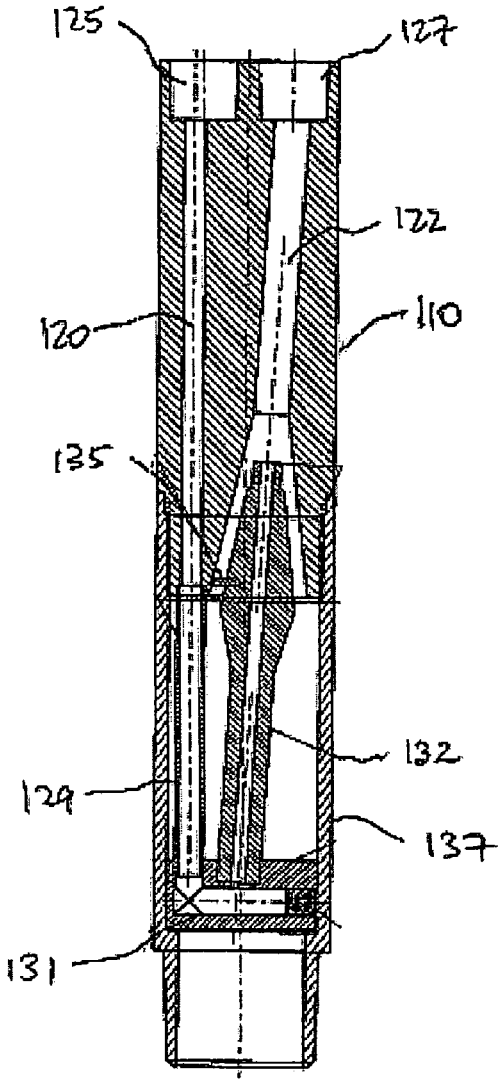
FIG. 8A is a cross-sectional view of one alternative embodiment of the invention.
Figure 8B:
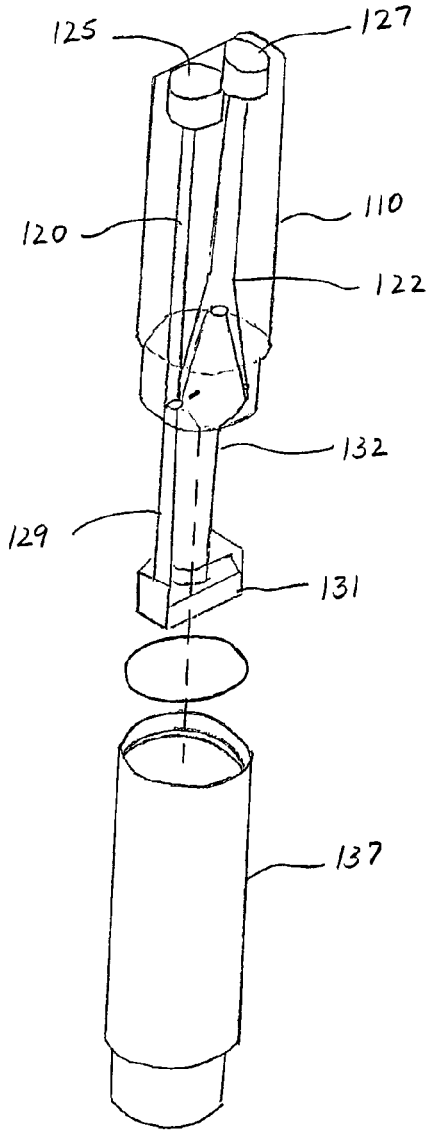
FIG. 8B is an exploded perspective view of this embodiment.

In an alternative embodiment, the system comprises a single supply tube and a single return tube, which are not concentric. As shown in FIGS. 8A and 8B, the body (110) defines a single gas supply passage (120) and a return passage (122). At an upper end, the gas supply passage begins with a supply port (125) which mates with a supply tube, which may be a sealed element run on coiled tubing. The return passage may have a similar return port (127).

At a lower end, the gas supply passage flows into a downtube (129) which connects with an end-block (131). The end-block (131) traverses the return passage (122) and redirects gas upward into the jet nozzle (132). The jet nozzle (132) is disposed within the return passage (122) in a position within the lower end of the body (110), and has a conically shaped section to fit with a conically shaped venturi chamber (122). The jet nozzle may be centerd within the return passage by a simple centering pin (135).

The upper end of the body (110) may be tapered as shown in FIG. 8B. The body (110), with the downtube (129), end-block (131) and lower portion of the jet nozzle assembled, may fit with a lower body (137) which has a lower portion adapted to engage a screen section (not shown).

Operation of this embodiment uses side-by-side tubular or jointed tubing, one of which is the supply tube, and the other is the return tube. The jet nozzle (132) receives compressed gas from the gas supply passage (120) and directs a stream of compressed gas into the return passage (122) in an upward direction. The stream of compressed gas creates a venturi effect, mixes with fluid from the fluid inlet (118) and the resultant fluid:gas mixture travels through the return passage (122) into the return port (127) and up the return tube.

Figure 9A:
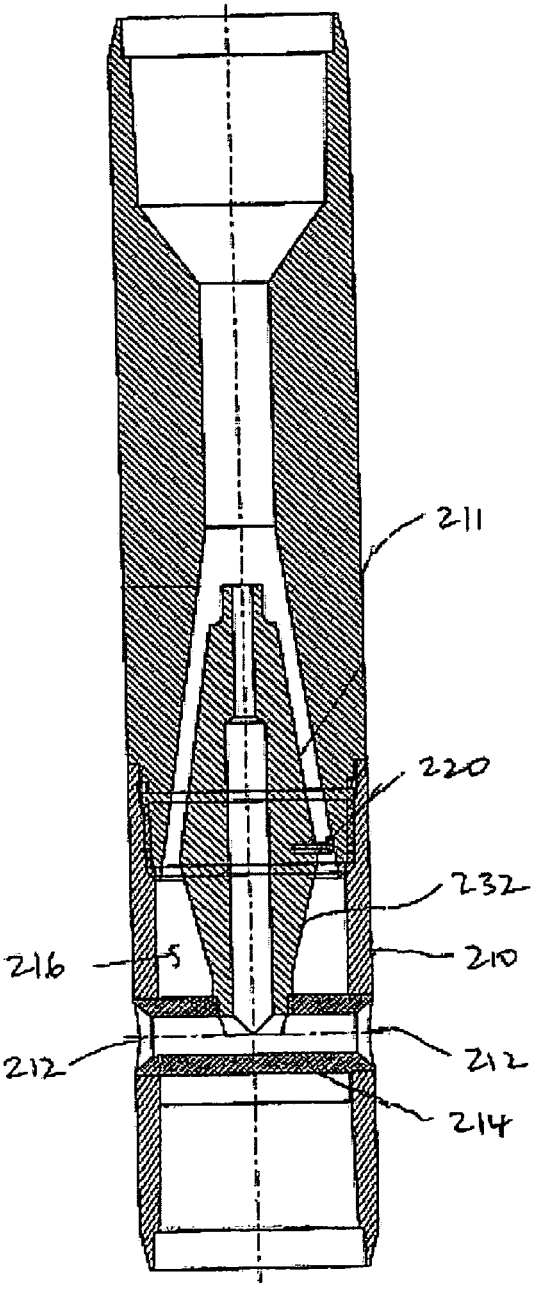
FIG. 9A is a cross-sectional view of another alternative embodiment of the invention.
Figure 9B:
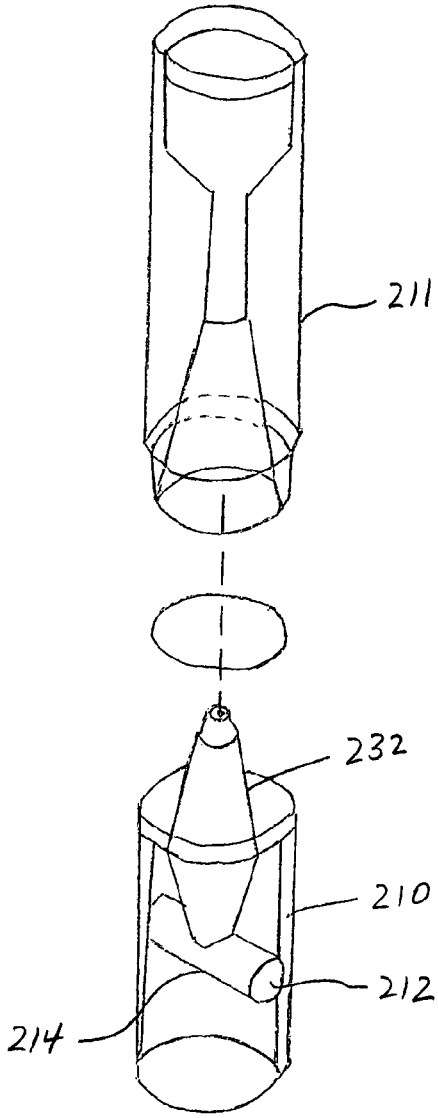
FIG. 9B is an exploded perspective view of this embodiment.

In an alternative embodiment shown in FIGS. 9A and 9B, the device may be run into a wellbore on a single return tubing string. The compressed gas is supplied between the well casing and the return tubing. Of course a packer (not shown) is necessary below the device to isolate the wellbore. In one embodiment, a lower body (210) defines at least one lateral supply port (212) in the lower body wall. In one example, two supply ports are provided which are connected with a cross-tube (214), which traverses the return passage (216). The cross tube (214) is in fluid communication with the lower end of a jet nozzle (232) which extends upwardly.

An upper body (211) defines a return passage (216) having a conical section (218). When the lower body (210) and the upper body (211) mate, the jet nozzle (232) is positioned in the venturi chamber of the return passage. A centering pin (220) may help in keeping the jet nozzle (232) centred within the return passage (216). The lower body (210) is adapted to engage a packer section and a screen section (not shown).

In operation, an embodiment of the invention is assembled with the packer and screen, and inserted into the wellbore on a length of supply tubing connected to the upper body (211) and return passage (216). The device is lowered to the desired depth in the wellbore and the packer is placed in a conventional manner. At the wellhead, compressed gas is injected into the annular space between the supply tubing and well casing, into the supply ports (212) and cross-tube (214), and upwards into the jet nozzle (232).

Embodiments of the invention remove wellbore liquids from a wellbore, with compressed gas under pressure conveniently driving the system. The gas may be recycled for re-injection. Screening means included in the apparatus eliminate ingress of larger debris and other particles. Smaller fine particles in the well liquid such as clay, sand, coal fines and particles do not affect operation of the device. Further, the apparatus eliminates the requirement for complex, downhole moving parts which damage and wear out rapidly. In the present invention, the useful life of the apparatus is extended due to minimal downhole moving parts, with surface components including a compressor and separator operating at the surface. The apparatus may be installed permanently within the well, or temporarily since it is readily portable. The apparatus may be useful for removal of liquids or gases for example, in a conventional gas well (i.e., removal of wellbore fluid), a light oil well (i.e., removal of water and oil), or a coal bed methane well (i.e., dewatering, removal of sludge).

In one embodiment, electronic timers can be incorporated with the apparatus to maintain continuous or timed running. In one embodiment, the electronic timers are included as surface components. Where power requirements for the apparatus or any component thereof is described, one skilled in the art will realize that any suitable power source may be used, including, without limitation, electrical systems, rechargeable and non-rechargeable batteries, self-contained power units, or other appropriate sources.

As will be apparent to those skilled in the art, various modifications, adaptations and variations of the foregoing specific disclosure can be made without departing from the scope of the invention claimed herein.

What is claimed is:

1. An apparatus for removing liquid from a well bore having a well casing, said apparatus comprising;

(a) a body having an upper end and a lower end, the upper end having a gas inlet and a liquid outlet, the upper end of the body being adapted to releasably engage a lower end of a production tubing, the liquid outlet being adapted to releasably engage a lower end of a return tube whereby the production tubing acts as a supply tube supplying gas to the gas inlet and the return tube is contained within the production tubing, the lower end of the body defining an inlet;

(b) the body defining at least one gas supply passage extending through the body and in fluid communication with the gas inlet, and a return passage extending though the body and in fluid communication with the inlet and the liquid outlet, wherein the return passage has a venturi chamber;

(c) a jet nozzle directed upwardly and disposed within the venturi chamber, the jet nozzle having an inner bore in fluid communication with the gas supply passage by means of an end member; and (d) adjusting means for adjusting the position of the jet nozzle within the venturi chamber so as to adjust the size of a venturi gap and the liquid:gas ratio in a discharged mixture.

2. The apparatus of claim 1 comprising two gas inlets adjacent a central liquid outlet, such that the return tube is concentrically within the production tubing.

3. The apparatus of claim 2 wherein the gas inlets comprise perforated projections for restricting entry of debris into the gas supply passages.

4. The apparatus of claim 1, wherein the venturi chamber and the jet nozzle have a complementary conical shape, and the jet nozzle is surrounded by a venturi gap.

5. The apparatus of claim 1 wherein the adjusting means comprises a lower tube attached to the end member, an upper tube slidingly engaging the lower tube, and a lock nut for fixing the relative position of the upper tube to the lower tube, wherein the lower tube and upper tube attach to the jet nozzle.

6. The apparatus of claim 1 further comprising a landing seat comprising a seating nipple having a central bore, the seating nipple being releasably attachable to the end of the return tube, the seating nipple inserting into the return passage from the upper end of the body and the seating nipple engaging the landing seat in a sealed fashion.

7. The apparatus of claim 6, wherein the seating nipple has at least one sealing means on its outer diameter to seal against an inner wall of the return passage.

8. The apparatus of claim 7 wherein the at least one sealing means is a cup seal.

9. The apparatus of claim 1, further comprising at least one one-way valve element within the at least one gas supply passage, said valve element being moveable between an open position permitting gas flow towards the jet nozzle, and a closed position preventing fluid flow towards the supply tube.

10. The apparatus of claim 9, wherein the one-way valve comprises a ball valve having means for biasing the ball valve into closed position, wherein said biasing means may be overcome by gas pressure from the supply tube.

11. The apparatus of claim 1 wherein the inlet comprises a screen releasably attachable to the lower end of the body.

12. The apparatus of claim 1 further comprising a tubular section releasably attachable to the upper end of the body, the tubular section being configured to thread onto the end of a supply tube.

13. A method of removing liquid from a well bore, the well bore having casing, to a well head using the apparatus of claim 1, the method comprising:

(a) attaching an upper end of the apparatus to the lower end of a production tube and to the lower end of a return tube whereby the return tube is concentrically within the production tube;

(b) lowering the apparatus into the well bore to a depth whereby the inlet is submerged in liquid;

(c) injecting compressed gas into the production tube such that the gas is expelled by the jet nozzle creating a suction force in the venturi chamber, thereby drawing liquid up the return passage; and (d) collecting the liquid:gas mixture being discharged by the return tubing at the well head.

14. The method of claim 13 wherein the compressed gas comprises natural gas produced from the well bore.

15. The method of claim 13 wherein the apparatus comprises a packer which seals the apparatus to the casing.

16. The method of claim 13 wherein venturi gap is adjusted to select a desired liquid:gas ratio in the discharged mixture.

17. The method of claim 13 comprising a preliminary step of injecting a short burst of compressed gas into the return tube at the well head to remove fluid from the return tube and the return passage before injecting compressed gas into the production tube.

* * * * *